US005192591A

United States Patent [19]

Chance

[11] Patent Number: 5,192,591

[45] Date of Patent: Mar. 9, 1993

[54] SHORT DWELL COATER APPARATUS

[75] Inventor: James L. Chance, Rockton, Ill.

[73] Assignee: Beloit Technologies, Inc., Wilmington, Del.

[21] Appl. No.: 791,722

[22] Filed: Nov. 14, 1991

[51] Int. Cl.[5] ..... B05C 3/18; B05C 11/04; B05D 3/12

[52] U.S. Cl. ..... 427/356; 118/410; 118/413; 118/419

[58] Field of Search ..... 118/410, 413, 419; 427/356, 357, 358

[56] References Cited

U.S. PATENT DOCUMENTS

| | | | |
|---|---|---|---|
| 2,521,666 | 9/1950 | Knight et al. | 118/50 |
| 3,413,143 | 11/1968 | Cameron et al. | 118/410 |
| 3,640,752 | 2/1972 | Ishiwata et al. | 427/294 |
| 3,735,729 | 5/1973 | Bird | 118/50 |
| 4,257,343 | 3/1981 | Kullander | 118/50 |
| 4,628,856 | 12/1986 | Burgdorf | 118/50 |
| 4,839,201 | 6/1989 | Rantanen et al. | 118/413 X |
| 4,873,939 | 10/1989 | Eskelinen | 118/410 |
| 4,903,632 | 2/1990 | Sollinger | 118/410 X |

OTHER PUBLICATIONS

"The Flow Characteristics In a Short Dwell Coater" by D. E. Eklund & P. C. Norrdahl; Coating Conference; 1986; pp. 99-102.

"Relationship Between Flow Instability In Short Dwell . . . " by N. G. Triantafillopoulos & C. K. Aidun; *Coating Conference* 1990; pp. 309-324.

*Primary Examiner*—Michael G. Wityshyn

*Attorney, Agent, or Firm*—Dirk J. Veneman; Raymond W. Campbell; David J. Archer

[57] ABSTRACT

A short dwell coater apparatus is disclosed for the application of coating material to a web which is supported by a backing member. The apparatus includes a housing which is disposed closely adjacent to the backing member such that the web moves between the housing and the backing member. The housing defines an application zone which is connected to a pressurized source of the coating material. The application zone has an open face towards the web. A blade is adjustably secured to the housing and extends from the housing towards the web. The blade defines a downstream extremity of the application zone. A movable flow divider supported by the housing extends into the application zone. The divider has an upstream and a downstream end, with the downstream end being movably disposed in the vicinity of the blade for reducing the size of a flow vortex generated within the application zone due to movement of the web past the open face.

13 Claims, 1 Drawing Sheet

SHORT DWELL COATER APPARATUS

BACKGROUND OF THE INVENTION

1. Field of the Invention

The present invention relates to a short dwell coater apparatus for the application of coating material to a web which is supported by a backing member. More particularly, the present invention relates to a short dwell coater apparatus having means for reducing a vortex generated within the application zone of the apparatus.

2. Information Disclosure Statement

Short dwell coaters permit the application of pressurized coating material to a web movably supported on a backing roll.

Typically, a short dwell coater includes an application zone having an open face towards the web so that the coating material is applied to the web with excess coating material being removed from the web by a blade defining the downstream end of the application zone.

Short dwell coaters permit the application of a relatively thin layer of coating material to a web because the dwell time of the web moving past the application zone is relatively short. Therefore, the coating material has little time to absorb deeply into the surface of the web to be coated.

The aforementioned short dwell coater also has the advantage that by applying a relatively thin coating to the web, economy of coating material is achieved.

However, during high speed application of coating material utilizing a short dwell coater apparatus, it has been observed that machine directional streaks appear on the surface of the coated web.

More particularly, it is thought that such streaking is as a result of air passing between the web and the apparatus becoming entrapped within the application zone and such air forming a vortex within the application zone due to the momentum of the web moving past the application zone.

The present invention seeks to overcome the aforementioned problem by the provision of a movable flow divider located within the application zone for dampening the aforementioned vortex and for reducing the size thereof.

Therefore, it is a primary objective of the present invention to provide a short dwell coater apparatus which overcomes the aforementioned inadequacies of the prior art devices and which makes a considerable contribution to the art of short dwell coating.

Another object of the present invention is the provision of a short dwell coater apparatus having a movable flow divider which is supported by a housing and which extends into the application zone. The divider has a downstream end which is movably disposed in the vicinity of a blade for reducing the size of the flow vortex generated within the application zone.

Other objects and advantages of the present invention will be readily apparent to those skilled in the art by a consideration of the detailed description contained hereinafter, taken in conjunction with the annexed drawings.

SUMMARY OF THE INVENTION

The present invention relates to a short dwell coater apparatus for the application of coating material to a web which is supported by a backing member. The apparatus includes a housing which is disposed closely adjacent to the backing member such that the web moves between the housing and the backing member. The housing defines an application zone which is connected to a pressurized source of coating material. The application zone has an open face towards the web.

Blade means is adjustably secured to the housing and extends from the housing towards the web. The blade defines a downstream extremity of the application zone.

Movable flow divider means is supported by the housing and extends into the application zone. The divider means has an upstream and a downstream end, with the downstream end being movably disposed in the vicinity of the blade means for reducing the size of a flow vortex generated within the application zone due to movement of the web past the open face.

In a more specific embodiment of the present invention, the application zone also includes an inlet, which is connected to the pressurized source, and an outlet.

A fixed baffle extends into the application zone and is disposed between the flow divider means and the outlet for controlling the direction of flow of the coating material within the application zone from the inlet to the outlet.

The open face extends from the inlet to the blade means.

The blade means also includes a first and a second end, with the first end being disposed adjacent to the web for metering excess coating material from the web.

Means are disposed adjacent to the second end of the blade means for securing the second end of the blade means relative to the housing.

Also, pneumatic tube means are disposed between the first and the second ends of the blade means for controlling the pressure applied by the first end of the blade means such that the amount of coating material metered by the blade means is controlled.

In one embodiment of the present invention, the movable flow divider means is a solid LEXAN sheet. In another embodiment of the present invention, the divider means is a composite material, such composite material including LEXAN. LEXAN is a registered trademark of General Electric Company. LEXAN is a polycarbonate resin sheet.

In one embodiment of the present invention, the divider means is perforated, and in another embodiment of the present invention, the divider means is solid.

The upstream end of the divider means is disposed in the vicinity of the inlet. The arrangement is such that a flow of the coating material entering the application zone through the inlet is divided by the divider means into a first and a second flow path. The first flow path is disposed between the web and the divider means. The second flow path is disposed between the divider means and the outlet such that the divider means tends to reduce the vortex generated within the application zone as a result of air entering the application zone between the housing and the web.

In a preferred embodiment of the present invention, the divider means is a flexible sheet which is anchored at the upstream end thereof and which is unsupported at the downstream end thereof such that the sheet oscillates within the application zone for dampening and reducing the size of the vortex.

Many modifications and variations of the present invention will be readily apparent to those skilled in the art by a consideration of the detailed description contained hereinafter, taken in conjunction with the annexed drawings.

BRIEF DESCRIPTION OF THE DRAWINGS

Similar reference characters refer to similar parts throughout the various views of the drawings.

DETAILED DESCRIPTION OF THE DRAWINGS

Figure 1:
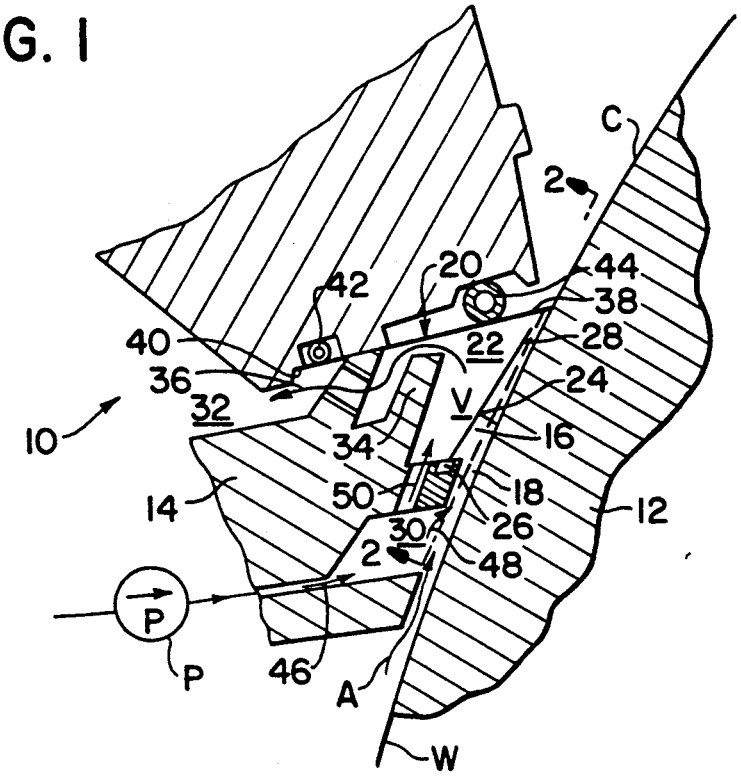
FIG. 1 is a fragmentary sectional view showing a short dwell coater apparatus according to the present invention.

The drawing shows a short dwell coater apparatus, generally designated 10, for the application of coating material C to a web W, which is supported by a backing member 12. The backing member 12 may be a rotatable backing roll.

The apparatus 10 includes a housing 14 which is disposed closely adjacent to the backing member 12 such that the web W moves between the housing 14 and the backing member 12. The housing 14 defines an application zone 16 which is connected to a pressurized source P of the coating material C. The application zone 16 has an open face 18 towards the web W.

Blade means, generally designated 20, is adjustably secured to the housing 14 and extends from the housing 14 towards the web W. The blade means 20 defines a downstream extremity 22 of the application zone 16.

Movable flow divider means, generally designated 24, is supported by the housing 14 and extends into the application zone 16. The divider means 24 has an upstream and a downstream end 26 and 28, respectively. The downstream end 28 is movably disposed in the vicinity of the blade means 20 for reducing the size of a flow vortex V generated within the application zone 16 due to movement of the web W past the open face 18.

The application zone 16 also includes an inlet 30 which is connected to the pressurized source P and an outlet 32.

The coater apparatus 10 also includes a fixed baffle 34 which extends into the application zone 16 and is disposed between the flow divider means 24 and the outlet 32 for controlling the direction of flow, as indicated by the arrow 36, of the coating material C within the application zone 16 from the inlet 30 to the outlet 32.

The open face 18 extends from the inlet 30 to the blade means 20.

The blade means 20 also includes a first and a second end 38 and 40, respectively. The first end 38 is disposed adjacent to the web W for metering excess coating material C from the web W.

Means 42, such as a pneumatic tube, are disposed adjacent to the second end 40 of the blade means 24 for securing the second end 40 of the blade means 24 relative to the housing 14.

Pneumatic tube means 44 are disposed between the first and second ends 38 and 40, respectively, of the blade means 20 for controlling the pressure applied by the first end 38 of blade means 20 such that the amount of coating material metered by the blade means 20 is controlled.

Figure 2:
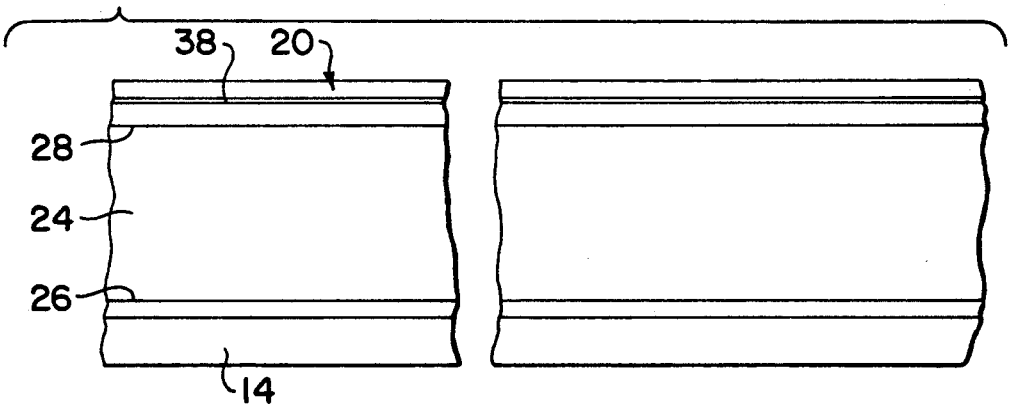
FIG. 2 is a sectional view taken on the line 2—2 of FIG. 1.

FIG. 2 is a sectional view taken on the line 2—2 shown in FIG. 1.

In one embodiment of the present invention as shown in FIG. 2, the flow divider means 24 is a solid LEXAN sheet. In another embodiment of the present invention, the divider means 24 is a composite material, such composite material including LEXAN.

Figure 3:
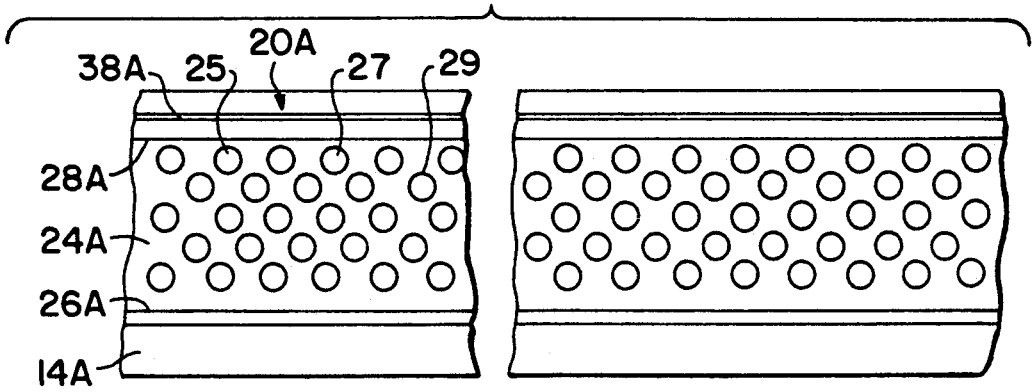
FIG. 3 is a similar view to that shown in FIG. 2 but shows an alternative embodiment of the present invention in which the divider means is perforated.

FIG. 3 is a sectional view similar to that shown in FIG. 2 but shows an alternative embodiment of the present invention, in which the divider means 24A is perforated so that the divider means 24 defines a plurality of holes 25,27,29.

The upstream end 26 of the divider means 24 is disposed in the vicinity of the inlet 30. The arrangement is such that a flow, as indicated by the arrow 46, of coating material C entering the application zone 16 through the inlet 30 is divided by the divider means 24 into a first and a second flow path 48 and 50, respectively. The first flow path 48 is disposed between the web W and the divider means 24. The second flow path 50 is disposed between the divider means 24 and the outlet 32 such that the divider means 24 tends to reduce the vortex V generated within the application zone 16 as a result of air, as indicated by the arrow A, entering the application zone 16 between the housing 14 and the web W.

The divider means 24 is preferably a flexible sheet which is anchored at the upstream end 26 and which is unsupported at the downstream end 28 such that the divider or sheet 24 oscillates within the application zone 16 for dampening and reducing the size of the vortex V.

In operation of the short dwell coater apparatus 10 according to the present invention, the web W supported by the backing roll 12 moves past the open face 18 of the application zone 16. Coating material C flows through inlet 30 so that the first flow path 48 causes coating material C to come into contact with the surface of the web W.

In a typical short dwell coater, there exists a tendency, especially at high speed, for air, as indicated by the arrow A, to enter into the application zone. Such entrained air, particularly due to the momentum of the web moving past the application zone, tends to generate a counter-clockwise vortex in a short dwell coater similar to that shown in FIG. 1 but without the benefits of the divider means 24 according to the present invention. Such vortex V usually increases in proportion to the velocity of the web so that at high speeds, air intermittently escapes past the blade means 20 to cause streaking of the web.

The present invention, by the provision of the divider means 24, dampens out the generation of the aforementioned vortex, or at least decreases the size of such vortex so that streaking of the coated web is inhibited.

The present invention provides a simple and inexpensive means of reducing streaking in a high speed short dwell coater.

What is claimed is:

1. A short dwell coater apparatus for the application of coating material to a web which is supported by a backing member, said apparatus comprising:

a housing disposed closely adjacent to the backing member such that the web moves between said housing and the backing member, said housing defining an application zone which is connected to a pressurized source of the coating material, said application zone having an open face directed towards the web;

blade means adjustably secured to said housing and extending from said housing towards the web, said blade means defining a downstream extremity of said application zone;

movable flow divider means supported by said housing and extending into said application zone, said divider means having an upstream and a downstream end, said downstream end being movably disposed in the vicinity of said blade means for reducing the size of a flow vortex generated within said application zone due to movement of the web past said open face, said upstream end being stationary relative to the web; and said divider means is a flexible sheet which is unsupported at said downstream end thereof such that said sheet oscillates within said application zone for dampening and reducing the size of said vortex.

2. A short dwell coater apparatus as set forth in claim 1, wherein said application zone further includes:

an inlet which is connected to said pressurized source; and an outlet.

3. A short dwell coater apparatus as set forth in claim 2, further including:

a fixed baffle extending into said application zone and disposed between said flow divider means and said outlet for controlling the direction of flow of the coating material within said application zone from said inlet to said outlet.

4. A short dwell coater apparatus as set forth in claim 2, wherein said open face extends from said inlet to said blade means.

5. A short dwell coater apparatus as set forth in claim 1, wherein said blade means further includes:

a first and a second end, said first end being disposed adjacent to the web for metering excess coating material from the web;

means disposed adjacent to said second end of said blade means for securing said second end of said blade means relative to said housing;

pneumatic tube means disposed between said first and second ends of said blade means for controlling the pressure applied by said first end of said blade means such that the amount of coating material metered by said blade means is controlled.

6. A short dwell coater apparatus as set forth in claim 1, wherein said movable flow divider means is a solid polycarbonate resin sheet.

7. A short dwell coater apparatus as set forth in claim 1, wherein said movable flow divider means is of a composite material, said composite material including a polycarbonate resin.

8. A short dwell coater apparatus as set forth in claim 1, wherein said movable flow divider means is perforated.

9. A short dwell coater apparatus as set forth in claim 1, wherein said movable flow divider means is solid.

10. A short dwell coater apparatus as set forth in claim 2, wherein:

said upstream end of said divider means is disposed in the vicinity of said inlet, the arrangement being such that a flow of the coating material entering said application zone through said inlet is divided by said divider means into a first and a second flow path, said first flow path being disposed between the web and said divider means, said second flow path being disposed between said divider means and said outlet such that said divider means tends to reduce the vortex generated within said application zone as a result of air entering said application zone between said housing and the web.

11. A short dwell coater apparatus as set forth in claim 10, wherein:

said flexible sheet is anchored at said upstream end thereof.

12. A short dwell coater apparatus for the application of coating material to a web which is supported by a backing member, said apparatus comprising:

a housing disposed closely adjacent to the backing member such that the web moves between said housing and the backing member, said housing defining an application zone which is connected to a pressurized source of the coating material, said application zone having an open face directed towards the web;

blade means adjustably secured to said housing and extending from said housing towards the web, said blade means defining a downstream extremity of said application zone;

movable flow divider means supported by said housing and extending into said application zone, said divider means having an upstream and a downstream end, said downstream end being movably disposed in the vicinity of said blade means for reducing the size of a flow vortex generated within said application zone due to movement of the web past said open face; and said flow divider means being a flexible sheet which includes a polycarbonate resin such that the sheet oscillates within the application zone, said divider means defining a plurality of holes therein for dampening the generation of said flow vortex within said application zone so that streaking of the coated web at high coating velocity is reduced.

13. A method for the application of coating material to a web which is supported by a backing roll, said method comprising the steps of:

moving the web between a housing and the backing roll, the housing defining an application zone which is connected to a pressurized source of the coating material, the application zone having an open face directed towards the web;

adjustably securing a blade to the housing such that the blade extends from the housing towards the web, the blade defining a downstream extremity of the application zone for metering excess coating material from the web; and dividing a flow of coating material entering the application zone into a first and a second flow path by the provision of a flow divider which is supported by the housing and which extends into the application zone, the divider having an upstream and a downstream end with the downstream end being movably disposed in the vicinity of the blade such that the divider oscillates within the application zone for reducing the size of a flow vortex generated within the application zone due to movement of the web past the open face, thereby reducing streaking of the coated web at high coating velocities.

* * * * *